US010601167B2

(12) United States Patent
Kondo

(10) Patent No.: US 10,601,167 B2
(45) Date of Patent: Mar. 24, 2020

(54) CONNECTOR

(71) Applicant: Sumitomo Wiring Systems, Ltd., Yokkaichi, Mie (JP)

(72) Inventor: Tomoyuki Kondo, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/314,686

(22) PCT Filed: Jun. 16, 2017

(86) PCT No.: PCT/JP2017/022244
§ 371 (c)(1),
(2) Date: Jan. 2, 2019

(87) PCT Pub. No.: WO2018/008361
PCT Pub. Date: Jan. 11, 2018

(65) Prior Publication Data

US 2019/0319396 A1 Oct. 17, 2019

(30) Foreign Application Priority Data

Jul. 6, 2016 (JP) ..... 2016-133898

(51) Int. Cl.
*H01R 13/52* (2006.01)
*H01R 13/41* (2006.01)

(52) U.S. Cl.
CPC ..... *H01R 13/521* (2013.01); *H01R 13/41* (2013.01); *H01R 13/5202* (2013.01)

(58) Field of Classification Search
None
See application file for complete search history.

(56) References Cited

U.S. PATENT DOCUMENTS 5,336,101 A * 8/1994 Kasugai ..... H01R 13/5219 439/272
5,399,045 A * 3/1995 Yoneda ..... H01R 13/5219 403/321

(Continued)

FOREIGN PATENT DOCUMENTS

JP 11-86974 3/1999
JP 2001-35576 2/2001

(Continued)

OTHER PUBLICATIONS

International Search Report dated Aug. 29, 2017.

*Primary Examiner* — Oscar C Jimenez
(74) *Attorney, Agent, or Firm* — Gerald E. Hespos; Michael J. Porco; Matthew T. Hespos

(57) ABSTRACT

A connector (relay connector 10) disclosed by this specification includes a first housing 21 having a terminal accommodating portion 24 into which first terminals 22 are to be accommodated, a second housing 51 including a receptacle 52 into which the first housing 21 is to be accommodated, the receptacle 52 being annularly continuous over an entire periphery, rubber plugs 30 fixed to the first terminals 22 and accommodated inside a rubber plug accommodating portion 25 provided to project rearward from a rear surface 24A of the terminal accommodating portion 24, and a potting agent 60 filled between an inner peripheral surface of the receptacle 52 and an outer peripheral surface of the first housing 21.

2 Claims, 8 Drawing Sheets

(56) References Cited

U.S. PATENT DOCUMENTS

| | | | | |
|---|---|---|---|---|
| 5,641,943 | A * | 6/1997 | Sawamura | H01R 4/22 174/74 A |
| 6,739,908 | B2 * | 5/2004 | Hamai | H01R 13/5208 439/587 |
| 7,361,055 | B2 * | 4/2008 | Fuerst | H01R 13/514 439/620.09 |
| 10,276,972 | B1 * | 4/2019 | Lai | H01R 13/4367 |
| 2001/0049226 | A1 | 12/2001 | Murakami et al. | |
| 2006/0099842 | A1 * | 5/2006 | Hayashi | H01R 13/506 439/271 |
| 2006/0270255 | A1 * | 11/2006 | Ishikawa | H01R 13/631 439/141 |
| 2011/0053403 | A1 * | 3/2011 | Tsuruta | H01R 13/4365 439/345 |
| 2011/0053408 | A1 * | 3/2011 | Tsuruta | H01R 13/621 439/362 |
| 2012/0149226 | A1 * | 6/2012 | Ishibashi | H01R 13/5221 439/271 |
| 2014/0011383 | A1 | 1/2014 | Uchida | |
| 2015/0140852 | A1 * | 5/2015 | Reinhardt | H01R 13/504 439/278 |
| 2016/0099527 | A1 * | 4/2016 | Loveless | H01R 13/6592 439/607.01 |
| 2016/0154185 | A1 | 6/2016 | Mori et al. | |
| 2016/0240959 | A1 * | 8/2016 | Uttarkar | H01R 13/6272 |
| 2017/0070012 | A1 * | 3/2017 | Hiramatsu | H01R 13/46 |

FOREIGN PATENT DOCUMENTS

| | | |
|---|---|---|
| JP | 2001-345143 | 12/2001 |
| JP | 2006-236903 | 9/2006 |
| JP | 2014-17085 | 1/2014 |
| JP | 2015-38835 | 2/2015 |
| JP | 2015-153609 | 8/2015 |

* cited by examiner

Conventional Connector

Conventional Connector

CONNECTOR

BACKGROUND

Field of the Invention

This specification relates to a connector.

Related Art

Japanese Unexamined Patent Publication No. 2014-17085 discloses a connector for preventing a short circuit between terminals. This connector includes a first housing and a second housing having an accommodating portion into which the first housing is fittable. The first housing is provided with a lock arm having a lock projection, whereas the second housing is provided with a lock hole into which the lock projection is to be fit. The lock projection is fit into the lock hole when the first housing is fit into the accommodating portion of the second housing, thereby locking the first housing and the accommodating portion in a fit state.

A first fitting surface of the first housing faces a second fitting surface on a back part of the accommodating portion in a fitting direction when the accommodating portion and the first housing are fit together, and front connecting portions of relay terminals project forward from the second fitting surface. Further, foreign matter intrusion preventing protrusions project on the second fitting surface and fit to foreign matter intrusion preventing recesses provided in the first fitting surface in the fitting direction when the first housing and the accommodating portion are fit together. The foreign matter intrusion preventing protrusions and the foreign matter intrusion preventing recesses form a labyrinth structure and extend a creepage distance between adjacent front connecting portions.

In the above configuration, a measure against foreign matter is taken by extending the creepage distance. However, foreign matter can intrude between the fitting surfaces from the lock hole. Therefore, this existing measure is not a perfect measure against foreign matter. A rubber ring between the outer peripheral surface of the first housing and the inner peripheral surface of the accommodating portion could prevent intrusion of foreign matter between the housings. However, the rubber ring must be at a position to avoid the lock arm. Thus, the connector is enlarged in the fitting direction and also in a radial direction due to a thickness of the rubber ring.

SUMMARY

A connector disclosed by this specification includes a first housing having a terminal accommodating portion and a first terminal accommodated into the terminal accommodating portion. The connector also includes a second housing having a receptacle that is configured to accommodate the first housing. The receptacle is annularly continuous over an entire periphery. A rubber plug is fixed to the first terminal and is accommodated inside a rubber plug accommodating portion that projects rearward from a rear surface of the terminal accommodating portion. A potting agent is filled between an inner peripheral surface of the receptacle and an outer peripheral surface of the first housing.

According to this configuration, the rubber plug prevents intrusion of foreign matter into the terminal accommodating portion. Further, the receptacle is annularly continuous over the entire periphery. Thus, the potting agent is sufficient to prevent the intrusion of foreign matter between the inner peripheral surface of the receptacle and the outer peripheral surface of the first housing. Accordingly, the connector completely prevents the intrusion of foreign matter into the receptacle.

The rear surface of the terminal accommodating portion may be accommodated inside the receptacle, and a filling space into which the potting agent is to be filled may be defined by the inner peripheral surface of the receptacle, the rear surface of the terminal accommodating portion and the outer peripheral surface of the rubber plug accommodating portion. According to this configuration, the filling space is open rearward, and the potting agent easily is filled into the filling space.

The terminal accommodating portion may include a press-fit projection to be press-fit into a press-fit recess provided in a back part of the receptacle, and the terminal accommodating portion may be held in the receptacle by press-fitting the press-fit projection into the press-fit recess. According to this configuration, the housings can be held connected by press-fitting the press-fit projection into the press-fit recess. Thus, the receptacle need not have a lock hole.

Accordingly, the connector disclosed by this specification completely prevents intrusion of foreign matter into the receptacle.

DETAILED DESCRIPTION

An embodiment is described with reference to FIGS. 1 to 8. A relay connector 10 of this embodiment is composed of a first connector 20 provided in a device such as a transmission and a second connector 50 mounted on a case of the device. Transmission oil containing metal foreign matter circulates inside the case of the device.

Figure 4:
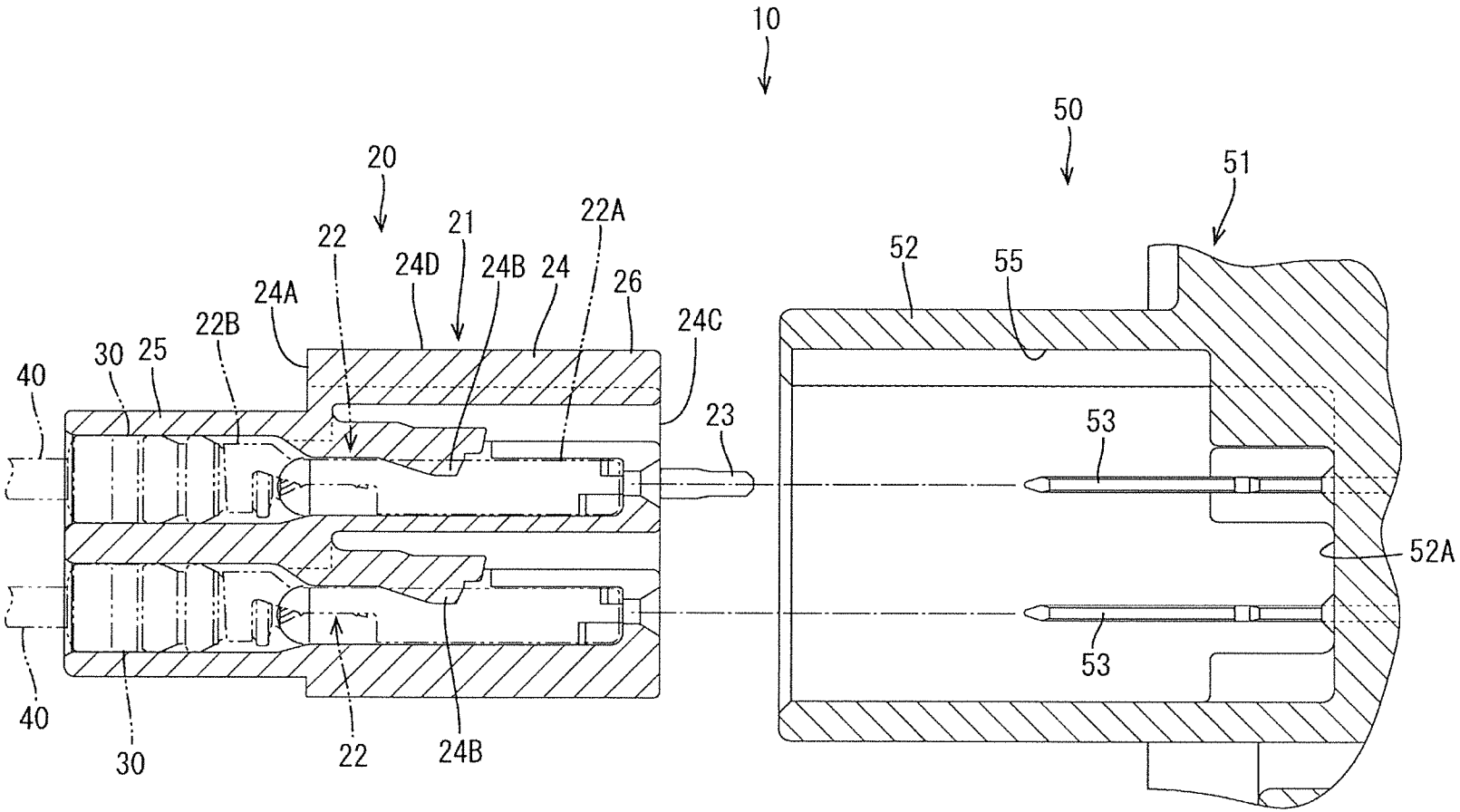
FIG. 4 is a section showing a state before the first housing is fit into a receptacle of the second housing.

As shown in FIG. 4, the first connector 20 includes a first housing 21 made of synthetic resin. First terminals 22 are accommodated inside the first housing 21 and press-fit projections 23 made of metal project forward from the front surface of the first housing 21.

The first terminal 22 includes a box 22A in the form of a rectangular tube, and a crimping portion 22B connected behind the box 22A. An unillustrated resilient contact piece is provided inside the box 22A. Further, the crimping portion 22B is composed of a wire barrel to be crimped to a core of a wire 40 and an insulation barrel to be crimped to a rubber plug 30. Thus, the rubber plug 30 and a coating of the wire 40 are fixed collectively to the insulation barrel.

The first housing 21 includes a terminal accommodating portion 24 for accommodating the boxes 22A of the first terminals 22 inside, and a rubber plug accommodating portion 25 for accommodating the rubber plugs 30 inside.

The rubber plug accommodating portion 25 projects rearward from a rear surface 24A of the terminal accommodating portion 24. Locking lances 24B are cantilevered inside the terminal accommodating portion 24 for locking and retaining the boxes 22A.

Figure 2:
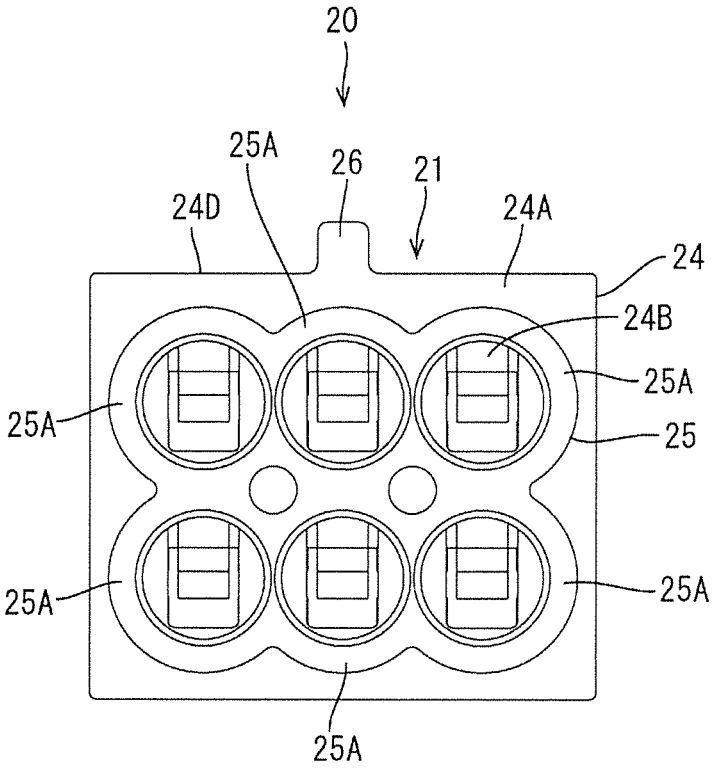
FIG. 2 is a back view of the first housing.

As shown in FIG. 2, the rubber plug accommodating portion 25 has cylindrical portions 25A arranged in vertical and lateral directions. The cylindrical portions 25A are coupled to each other and the rubber plug 30 are accommodated respectively into the cylindrical portions 25A.

Figure 1:
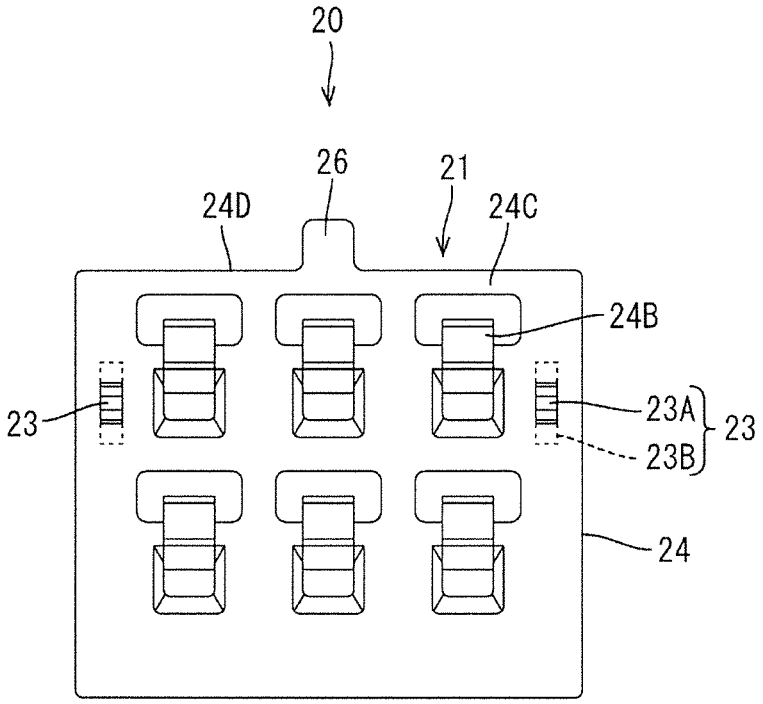
FIG. 1 is a front view of a first housing.

As shown in FIG. 1, two of the press-fit projections 23 are fixed to a front surface (fitting surface) 24C of the terminal accommodating portion 24. Each press-fit projection 23 includes a press-fitting portion 23A projecting forward and a fixing portion 23B extending vertically on a rear part of the press-fitting portion 23A, and is fixed to the front surface 24C of the terminal accommodating portion 24 while being retained so as not to come out forward by embedding (insert molding) the fixing portion 23B in the terminal accommodating portion 24. An erroneous mounting preventing rib 26 projects up on an upper surface 24D of the terminal accommodating portion 24.

As shown in FIG. 4, the second connector 50 includes a second housing 51 made of synthetic resin. The second housing 51 is provided with a receptacle 52 into which the terminal accommodating portion 24 of the first housing 21 is fittable. The receptacle 52 is open toward a side to be fit to the terminal accommodating portion 24, and is annularly continuous over the entire periphery.

Figure 5:
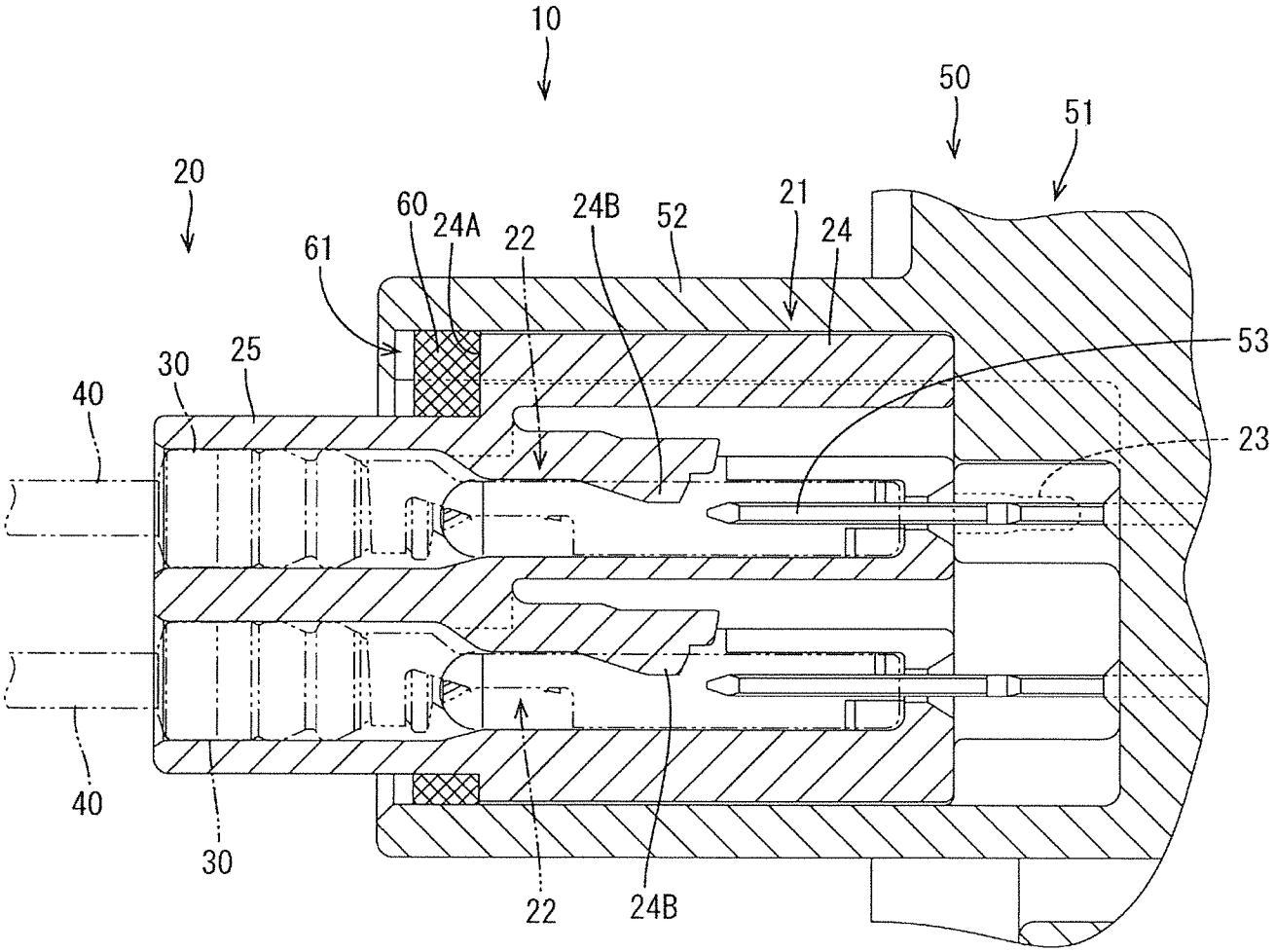
FIG. 5 is a section showing a state after the first housing is fit into the receptacle of the second housing.

As shown in FIG. 5, the receptacle 52 has a fitting bottom surface 52A that faces the front surface 24C of the terminal accommodating portion 24 when the receptacle 52 is fit to the terminal accommodating portion 24. Second terminals 53 extend through the fitting bottom surface 52A of the receptacle 52 and project toward an opening side. In a state fit into the box 22A of the first terminal 22, the second terminal 53 resiliently contacts the unillustrated resilient contact piece. In this way, the first terminal 22 and the second terminal 53 are connected conductively.

Figure 3:
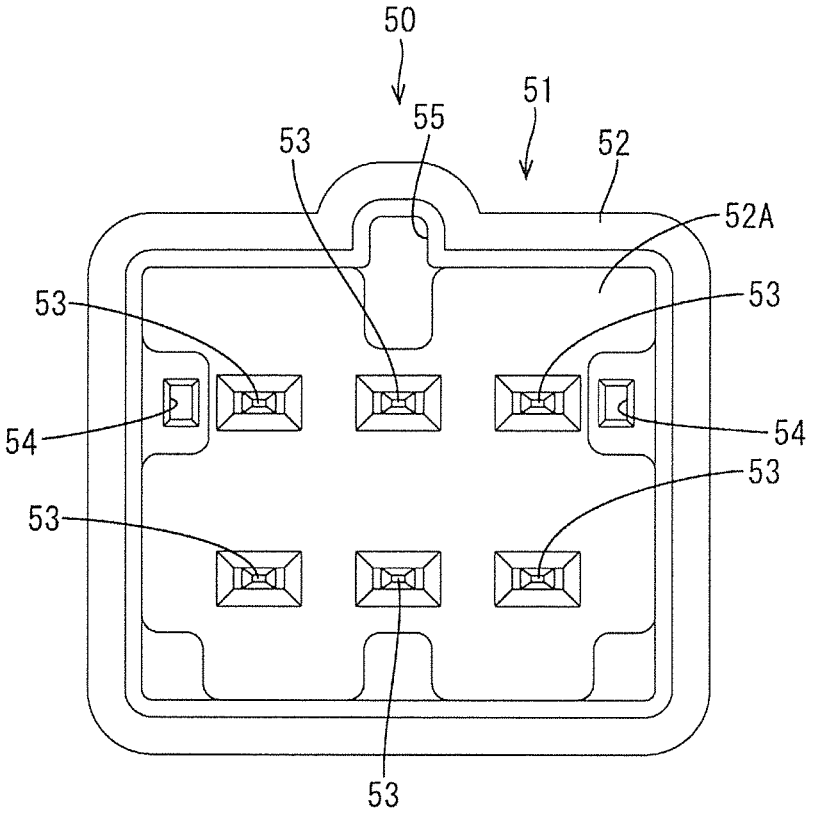
FIG. 3 is a front view of a second housing.

As shown in FIG. 3, two press-fit recesses 54 are provided in the fitting bottom surface 52A of the receptacle 52. The press-fit projections 23 of the first connector 20 can be press-fit into the press-fit recesses 54. When the terminal accommodating portion 24 of the first connector 20 is fit into the receptacle 52 of the second connector 50, the press-fitting portions 23A of the press-fit projections 23 are press-fit into the press-fit recesses 54 so that the first connector 20 and the second connector 50 are held connected and the first terminals 22 and the second terminal 53 are held connected conductively.

Further, an erroneous mounting preventing recess 55 is provided in the inner surface of the receptacle 52, and the erroneous mounting preventing rib 26 can enter the erroneous mounting preventing recess 55 when the first connector 20 and the second connector 50 are connected in proper postures. Conversely, the first connector 20 cannot be connected to the second connector 50 in a vertically inverted wrong posture.

Figure 6:
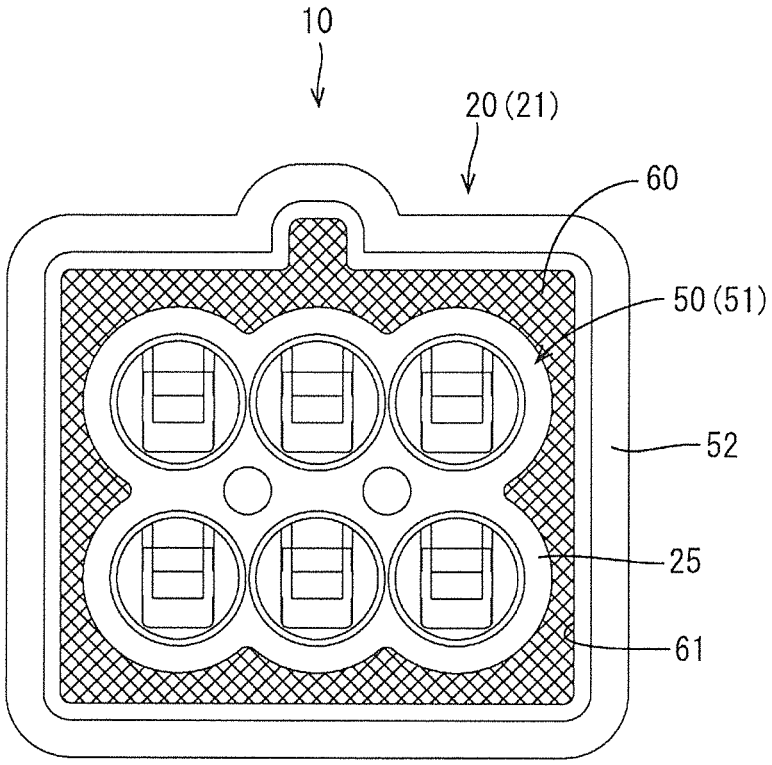
FIG. 6 is a view of a relay connector viewed from the side of the second housing.

As shown in FIG. 5, with the first connector 20 and the second connector 50 connected, the rear surface 24A of the terminal accommodating portion 24 is acccommodated inside the receptacle 52, and a filling space 61 is defined by the inner peripheral surface of the receptacle 52, the rear surface 24A of the terminal accommodating portion 24 and the outer peripheral surface of the rubber plug accommodating portion 25. As shown in FIG. 6, the filling space 61 surrounds the rubber plug accommodating portion 25 over the entire periphery. A potting agent 60 is provided in the filling space 61 at a position to close a clearance formed between the outer peripheral surface of the terminal accommodating portion 24 and the inner peripheral surface of the receptacle 52, and prevents the transmission oil, metal foreign matter and the like from intruding to the fitting bottom surface 52A through the clearance from the opening of the receptacle 52. Note that since the filling space 61 is open on the opening side of the receptacle 52, the potting agent 60 easily is filled into the filling space 61.

An internal space of the terminal accommodating portion 24 of the first housing 21 and an internal space of the rubber plug accommodating portion 25 communicate with each other. Additionally, the rubber plugs 30 are mounted into the rubber plug accommodating portion 25 to prevent the intrusion of water into the inside through an opening of the rubber plug accommodating portion 25. Further, there is no lock hole or other through hole in a peripheral wall of the receptacle 52, thereby further preventing the intrusion of water into the inside from the peripheral wall of the receptacle 52. Thus, there is no possibility that a metal foreign matter, for example, in the form of a thin thread intrudes into the receptacle 52 to short a pair of the second terminals 53, and the intrusion of foreign matter into the receptacle 52 can be prevented completely.

Figure 8:
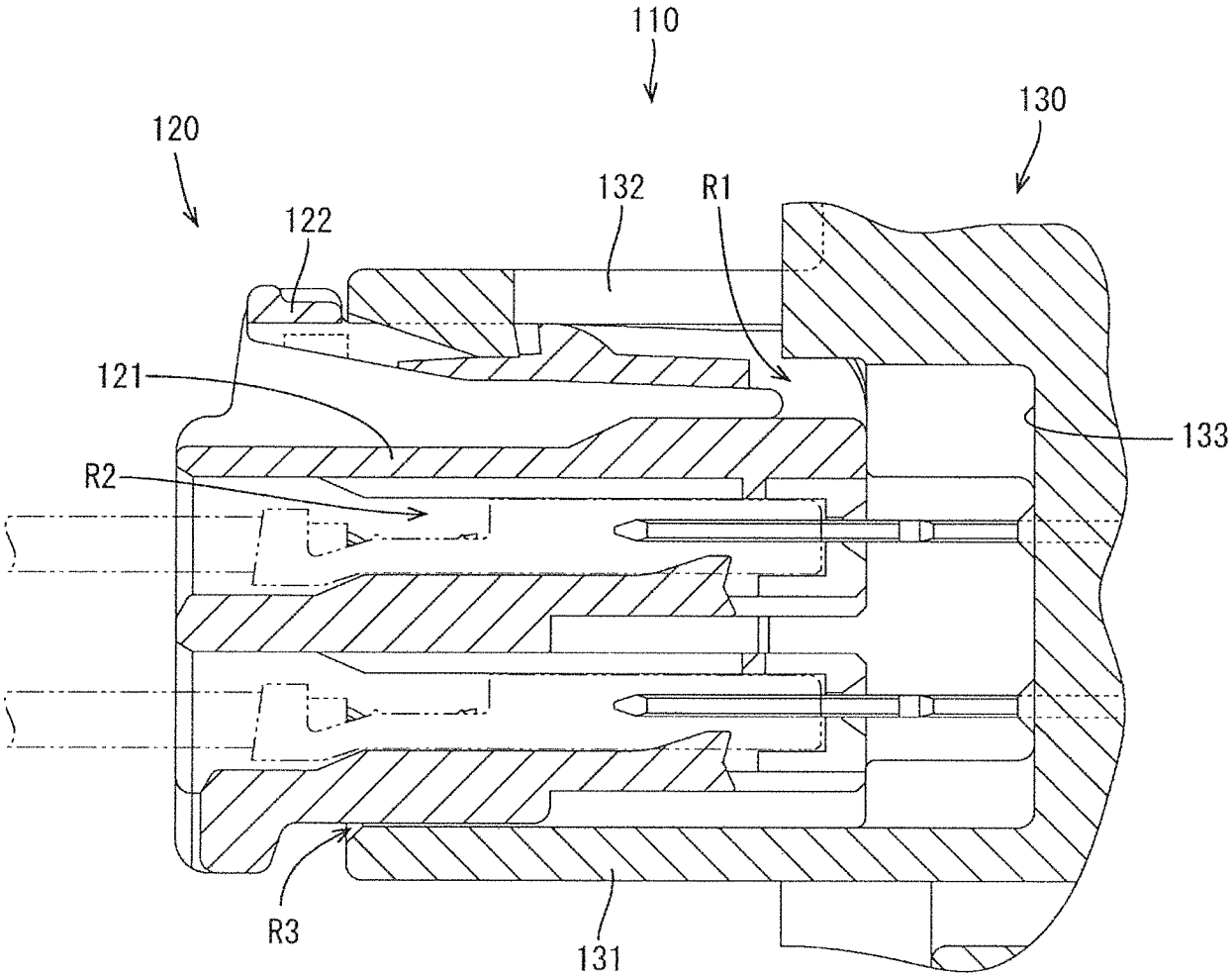
FIG. 8 is a section showing a connected state of the first housing and a second housing in the conventional structure.

A conventional relay connector 110 is shown in FIG. 8. The relay connector 110 is composed of a first connector 120 and a second connector 130 including a receptacle 131, and the first connector 120 is fittable into the receptacle 131. The relay connector 110 differs from the relay connector 10 of this embodiment in that no rubber plug is provided, a lock hole 132 is provided in the receptacle 131 and no potting agent is provided. Thus, the first connector 120 includes only a terminal accommodating portion 121 without including a rubber plug accommodating portion.

According to this configuration, there are three routes, i.e. a route R1 in which foreign matter intrudes into the receptacle 131 from the lock hole 132, a route R2 in which foreign matter intrudes into the inside from a rear end opening of the terminal accommodating portion 121 and a route R3 in which foreign matter intrudes into the inside through a clearance between the inner peripheral surface of the receptacle 131 and the outer peripheral surface of the terminal accommodating portion 121. Thus, the intrusion of foreign matter to a fitting bottom surface 133 of the receptacle 131 is allowed. On the other hand, these three routes R1, R2 and R3 are not present in the present invention, the foreign matter cannot intrude.

Figure 7:
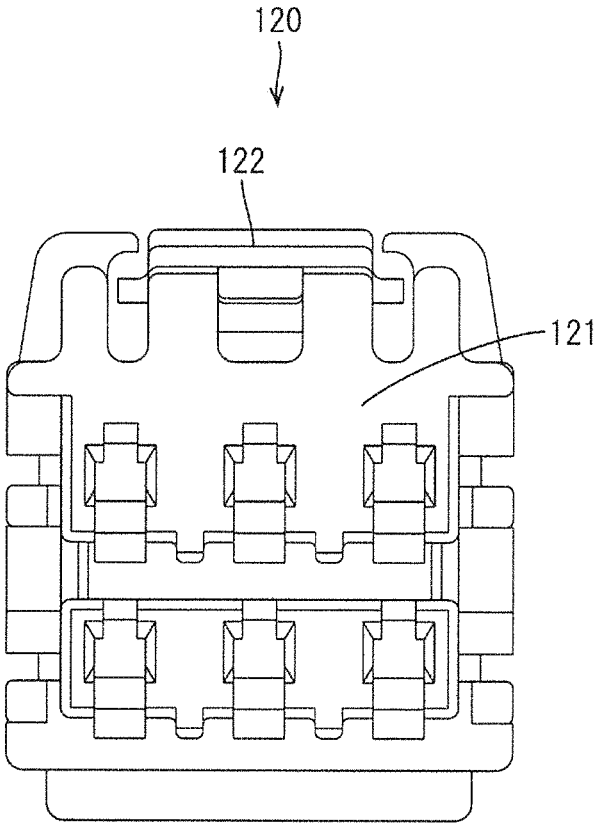
FIG. 7 is a front view of a first housing in a conventional structure.

Further, since the first connector 120 includes a lock arm 122 in the conventional relay connector 110, the first connector 120 is enlarged in a vertical direction by the lock arm 122 and a deflection space for the lock arm 122, as shown in FIG. 7. In contrast, the first connector 20 and the second connector 50 of the invention can be held connected by press-fitting the press-fit projections 23 into the press-fit recesses 54. Thus, the first connector 20 can be reduced in size in the vertical direction by as much as the lock arm. Further, since press-fitting is adopted for locking the connectors 20, 50, the enlargement of the first connector 20 by providing a deflection space can be avoided. Additionally, the press-fit projections 23 are insert-molded utilizing dead spaces in the front surface 24C of the terminal accommodating portion 24. Thus, the press-fit projections 23 can be provided without adding an extra space.

As described above, according to this embodiment, the intrusion of foreign matter into the terminal accommodating portion 24 can be prevented by the rubber plugs 30. Further, the receptacle 52 is annularly continuous over the entire periphery. Thus, it is sufficient to prevent the intrusion of foreign matter between the inner peripheral surface of the receptacle 52 and the outer peripheral surface of the first housing 21, and the potting agent 60 prevents this intrusion of foreign matter. Accordingly, the intrusion of foreign matter into the receptacle 52 can be prevented completely.

The rear surface of the terminal accommodating portion 24 may be accommodated inside the receptacle 52, and the filling space 61 into which the potting agent 60 is to be filled may be defined by the inner peripheral surface of the receptacle 52, the rear surface of the terminal accommodating portion 24 and the outer peripheral surface of the rubber plug accommodating portion 25. Accordingly, the filling space 61 is open rearward, and the potting agent 60 easily is filled into the filling space 61.

The terminal accommodating portion 24 may include the press-fit projections 23 to be press-fit into the press-fit recesses 54 provided in the back part (fitting bottom surface 52A) of the receptacle 52, and the terminal accommodating portion 24 may be held in the receptacle 52 by press-fitting the press-fit projections 23 into the press-fit recesses 54. According to this configuration, the housings 21, 51 can be held connected by press-fitting the press-fit projections 23 into the press-fit recesses 54. Thus, the receptacle 52 need not have a lock hole.

The invention is not limited to the above described and illustrated embodiment. For example, the following various modes are also included.

The filling space 61 is defined by the inner peripheral surface of the receptacle 52, the rear surface 24A of the terminal accommodating portion 24 and the outer peripheral surface of the rubber plug accommodating portion 25 in the above embodiment. However, the potting agent may be applied only to a right-angle part formed by the inner peripheral surface of the receptacle 52 and the rear surface 24A of the terminal accommodating portion 24. In short, the potting agent only has to be applied at a position to close a clearance formed between the inner peripheral surface of the receptacle 52 and the outer peripheral surface of the terminal accommodating portion 24 from behind.

The first housing 21 and the second housing 51 are held connected by press-fitting the press-fit projections 23 into the press-fit recesses 54 in the above embodiment. However, the housings 21, 51 may be held using the potting agent 60 as an adhesive without providing the press-fit projections 23 and the press-fit recesses 54.

Although the second connector 50 to be mounted on the case of the device is illustrated in the above embodiment, a second connector may be a wire-to-wire connector for connecting wires without being mounted on a case of a device.

LIST OF REFERENCE SIGNS

10 . . . relay connector
21 . . . first housing
22 . . . first terminal
23 . . . press-fit projection
24 . . . terminal accommodating portion
24A . . . rear surface
25 . . . rubber plug accommodating portion
30 . . . rubber plug
51 . . . second housing
52 . . . receptacle
52A . . . fitting bottom surface (back end part)
54 . . . press-fit recess
60 . . . potting agent
61 . . . filling space

The invention claimed is:

1. A connector, comprising:

a first housing including a terminal accommodating portion having opposite front and rear ends, a rubber plug accommodating portion projecting from the rear end of the terminal accommodating portion and being cross-sectionally smaller than the terminal accommodating portion, and a first terminal being accommodated into the terminal accommodating portion;

a second housing extending in forward to backward directions and including a receptacle annularly continuous over an entire periphery and open along an opening side of the second housing, and the first housing accommodated in the receptacle through the opening side so that the rear end of the terminal accommodating portion of the first housing is more forward than a front end of the second housing;

a rubber plug fixed to the first terminal and accommodated inside the rubber plug accommodating portion provided to project; and a potting agent filled into a rearwardly-open filling space defined by an inner peripheral surface of the receptacle, the rear end of the terminal accommodating portion, the rubber plug accommodating portion outer peripheral surface, and the opening side of the second housing.

2. The connector of claim 1, wherein the terminal accommodating portion includes a press-fit projection to be press-fit into a press-fit recess provided in a back end part of the receptacle, and the terminal accommodating portion is held accommodated inside the receptacle by press-fitting the press-fit projection into the press-fit recess.

* * * * *